United States Patent [19]

McCarthy

[11] 4,204,615

[45] May 27, 1980

[54] FITMENT FOR RENDERING A CONTAINER CHILD-RESISTANT

[75] Inventor: Robert F. McCarthy, Cincinnati, Ohio

[73] Assignee: The Procter & Gamble Company, Cincinnati, Ohio

[21] Appl. No.: 54,513

[22] Filed: Jul. 3, 1979

[51] Int. Cl.[2] ..... B67D 5/32; B67D 5/00

[52] U.S. Cl. ..... 222/153; 215/221

[58] Field of Search ..... 215/221, 216; 222/153

[56] References Cited

U.S. PATENT DOCUMENTS

| | | | |
|---|---|---|---|
| 3,885,712 | 5/1975 | Libit | 222/153 |
| 3,910,463 | 10/1975 | Reese | 222/153 |
| 3,935,963 | 2/1976 | Knize | 215/221 X |
| 3,958,709 | 5/1976 | Nixdorff | 215/221 |

*Primary Examiner*—George T. Hall

*Attorney, Agent, or Firm*—Richard C. Witte; Thomas H. O'Flaherty; John V. Gorman

[57] ABSTRACT

A fitment is provided to render a two-piece non-spurting twist open dispensing closure child-resistant. The fitment, which is adapted to be disposed between the tip and shell portions of the closure, is of annular configuration and is provided with an upwardly-biased lug at its outer periphery. The lug is adapted to engage fingergrip depressions located on the sidewall of the closure's tip portion. Engagement between the lug and one of the depressions occurs when the tip portion is rotated into its closed or non-dispensing position. Manual depression of the lug is required to disengage the lug from the fingergrip depression. The disengagement of lug from depression allows the tip portion to be rotated into its open or dispensing position.

3 Claims, 6 Drawing Figures

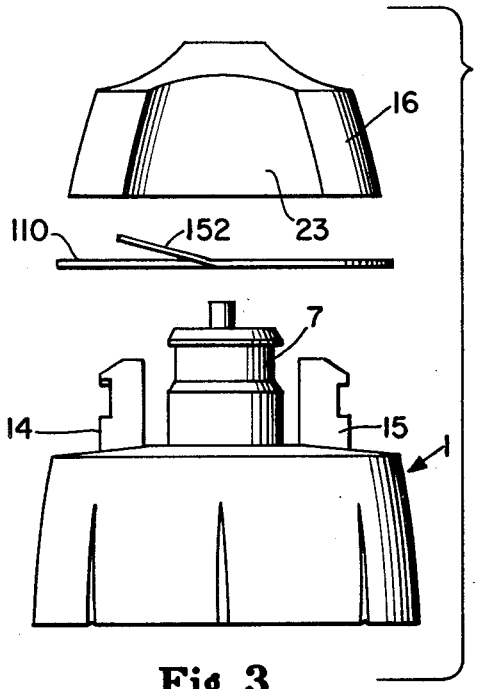
Fig. 1
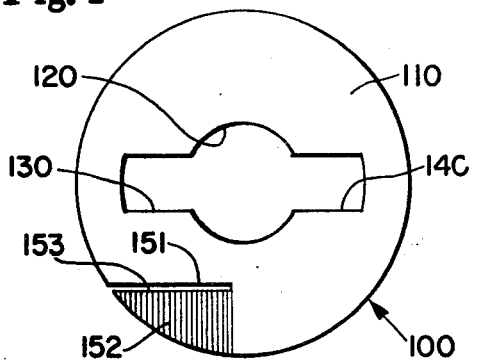
Fig. 2
Fig. 3
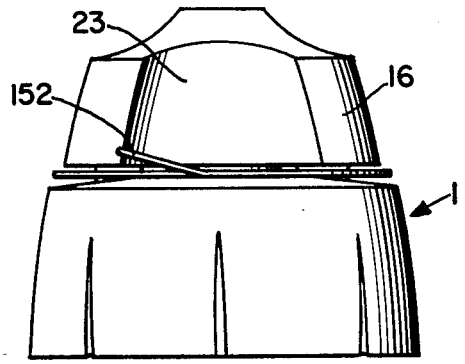
Fig. 4
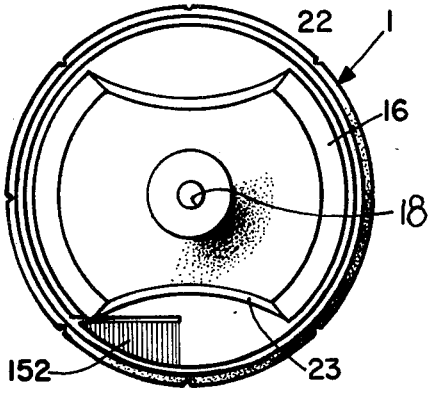
Fig. 5
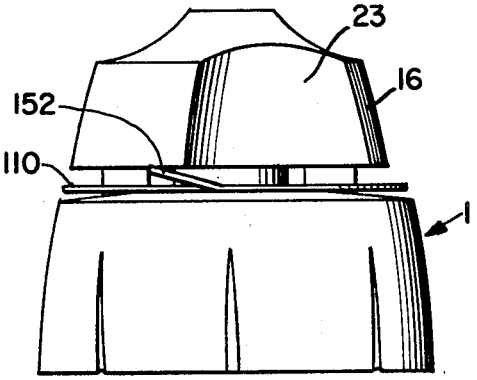
Fig. 6
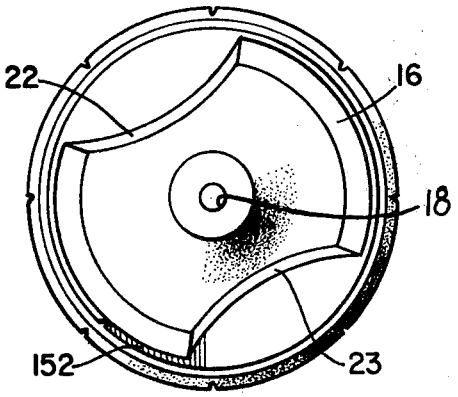

FITMENT FOR RENDERING A CONTAINER CHILD-RESISTANT

TECHNICAL FIELD

This invention relates to fitments which render closures child-resistant and more particularly to fitments which render twist-open dispensing closures child-resistant.

DESCRIPTION OF THE PRIOR ART

The instant invention was prompted by the need to prevent infants from tampering with a liquid dispenser without adult supervision. Similar motivation has led others to produce fitments to secure containers of medicines and the like from infants. All of such fitments act as locking mechanisms which must be unlocked in order to open the closure. The closure, with such mechanism, is made child-resistant because the added unlocking operation in opening the closure is too complex for an infant to master by his or her own initiative. For instance Bagguley, U.S. Pat. No. 3,700,133, issued Oct. 24, 1972, discloses a safety closure which includes an upwardly-biased safety button attached to the threaded neck of a container. The safety button seats in a notch provided in the base of a cap when the cap is tightened. The seating of the safety button prevents removal of the cap until the safety button is depressed and disengaged from the notch. Nixdorff, U.S. Pat. No. 3,744,655, issued July 10, 1973, discloses an annular fitment with an upstanding lug. The lug has an upstanding tooth which is adapted to coact with serrations located on the underside of a threaded cap. When the cap is tightened, the tooth engages the serrations to prevent the cap from rotating to an open position. In order to unscrew the cap it is necessary to disengage the tooth from the serrations by depressing the lug. As a result of this complexity of manual operation, the closure is rendered child-resistant. There are other designs for fitments which operate in a similar manner. Lungren, U.S. Pat. No. 2,980,275, (now expired) employs a ratchet mechanism similar to the aforementioned reference. An annular fitment is provided to encircle the base of a threaded neck. One end of the fitment has a recess which is adapted to receive a protuberance formed on the shoulder of the jar. Diametrically opposed to this recess is a tab with a ratchet-like tooth which engages serrations provided on the base of the cap. In order to unscrew the cap it is necessary to disengage the ratchet mechanism by deforming the tab. Landon, U.S. Pat. No. 3,884,379, issued May 20, 1975, provides an annular locking ring with diametrically opposed tabs. These tabs have ratchet-like teeth biased oppositely to serrations located on the underside of the cap. This opposite bias permits the serrations to ride over the teeth when the cap is tightened. In order to disengage the ratchet-like teeth from the serrations in the cap the tabs must be depressed.

In a preferred embodiment, the fitment of the subject invention is employed with a twist-open dispensing closure which can be set in dispensing and non-dispensing positions through rotation of a dispensing tip through a limited arc. In order to lock the closure, the tip is rotated about 40° at which point the lug of the fitment engages the fingergrip depression thereby locking the closure. This arrangement is particularly advantageous because the combination has safety features inherent in its operation. For instance, general safety is increased because a positive lock is provided to maintain the closure in its non-dispensing position. Because of the limited rotation of the tip in locking the closure, when the tip is rotated into its closed position, the fitment produces a single audible click thereby assuring the consumer that the closure is in fact closed. In addition to this, since the entire operation of the subject invention is in plain view, the large operative elements of the fitment can be visually inspected, even at some distance, to assure the consumer that the closure is set in a non-dispensing position.

Accordingly, it is the primary object of the present invention to provide a fitment which renders a twist-open dispensing closure child-resistant.

Another object of the present invention is to increase the general safety in handling containers outfitted with twist-open dispensing closures by providing a positive lock which also provides the consumer with visual and audible assurances that the closure is set in a non-dispensing position.

Still further objects of the present invention include providing a fitment to render a container child-resistant which is attractive and which can be manufactured at low cost.

DISCLOSURE OF THE INVENTION

In accordance with the invention, there is provided a latching member for a twist-to-open closure comprising a shell member with an outwardly-projecting spout having a tip member rotatably mounted thereon. The spout has a dispensing passageway therethrough. Limited rotation of the tip member relative to the shell member moves the tip member from a position in which the dispensing passageway is closed to one in which the dispensing passageway is open. The tip member is provided with a pair of extending opposed finger grip depressions to enable gripping for manual rotation between such open and closed positions.

The latching member has a disc-like body portion which is adapted to be disposed between the tip and shell members. The body portion is provided with means to prevent rotation of the latching member relative to the shell member. The body portion is also provided with at least one aperture enabling telescoping of the spout therethrough. A latching lug is connected to the body portion. The lug is angulated upwardly out of the plane of the disc and is resiliently deformable towards the plane of the disc. When the lug is disposed between the tip and the shell members, the lug will enter a finger grip depression and signal closure when the tip member is rotated into the closed position, the edge of the lug engaging the side of a depression to thereby prevent inadvertent rotation of the tip member into an open position. When the lug is manually depressed into the plane of the disc, the latching lug is moved out of the finger grip depression to enable rotation of the tip member to an open position.

BRIEF DESCRIPTION OF THE DRAWINGS

FIG. 1 is an exploded elevational view of a fitment of the present invention employed with a two-piece, twist-to-open dispensing closure.

FIG. 2 is a top plan view of the fitment of FIG. 1.

FIG. 3 is an elevational view of the dispensing closure and fitment of FIG. 1, showing the coacting of the fitment lug with the fingergrip depression of the closure in the non-dispensing position.

FIG. 4 is a top plan view of FIG. 3.

FIG. 5 is an elevational view of the dispensing closure fitment of FIG. 1, showing the position of the fitment lug when the closure is in its dispensing position.

FIG. 6 is a top plan view of FIG. 5.

DETAILED DESCRIPTION OF THE INVENTION

The specification concludes with claims pointing out and distinctly claiming the subject matter forming the present invention. It is believed, however, that the invention will be better understood from the following detailed description which when taken in connection with the accompanying drawings describes, discloses and illustrates a preferred embodiment presently believed to be the best mode of practicing the present invention.

Referring now to the drawings and particularly to FIG. 1 there is shown in a preferred embodiment the latching member of the present invention advantageously employed with the twist-to-open closure set forth in Haller, U.S. Pat. No. 4,065,037, issued Dec. 27, 1977, the disclosure of which is hereby incorporated by reference. While the present invention is by no means limited to this embodiment, for simplicity the invention will be discussed in connection with the closure set forth in Haller. Briefly, the closure consists of a molded plastic shell 1 for engagement with the neck or finish of the container, the shell having integrally formed therewith an upstanding cylindrical spout or chimney 7 and two diametrically opposed posts 14 and 15, located on either side of chimney 7, and a molded plastic tip 16 which is telescopically mounted on the chimney 7 and is shiftable between an open position and a retracted closed position. This is accomplished by an arrangement of inclined planes and thread segments (which are described in detail in the Haller patent) in the tip 16 which cooperate with posts 14 and 15 in order to threadedly engage tip 16 to shell 1. In the closed position, the tip 16 is retracted against shell 1 with plug 9 telescoped within tip dispensing opening 18. (Dispensing opening 18 can best be seen in FIGS. 4 and 6.) In order to open the closure the tip 16 is rotated counterclockwise with respect to the shell 1. Because of the mounting arrangement, as the tip is rotated, the tip rides away from the shell thereby removing plug 9 from tip dispensing opening 18. Rotation of the tip 16 is facilitated by diametrically opposed, upwardly and inwardly sloping skirt portions or finger grip depressions 22 and 23 which curve slightly inwardly towards the axis of the dispensing opening 18. As illustrated in FIG. 8 of Haller, webs 28 through 31 are provided on the inside of the dispensing tip. These webs, arrayed at right angles to each other, present stop surfaces **28*a* through 31*a*, which determine the open and closed position of the closure, by abutting with the sides of posts 14 and 15**. Because of the width of the posts and the web, the rotation of the tip is limited to about 40° between open and closed positions.

Disposed between the tip 16 and the shell 1 is the latching member 100 of the present invention. As illustrated in FIG. 2, the latching member 100 consists of a disc-like body portion 110 having a resilient lug 152 on its periphery. The body portion 110 is provided with an aperture 120 and two diametrically opposed slots 130 and 140 contiguous with the aperture 120. The slots 130 and 140 and aperture 120 are adapted to receive the chimney 7 and posts 14 and 15 of the shell 1 in order to prevent rotation of the body portion 110 relative to shell 1. The tip member 16 fits over the latching member 100 and holds it in place. The lug 152 is oriented with respect to slots 130, 140 so that when the tip 16 is rotated into its closed or non-dispensing position the lug engages the inwardly sloping skirt portions of finger grip depression 23 on tip 16. In order to rotate the tip member 16 into its open or dispensing position, the lug 152 must be depressed into the plane of the disc to disengage the lug from the fingergrip depression 23.

As stated hereinabove, rotation of the latching member 100 is prevented by the interaction of slots 130 and 140 with posts 14 and 15. Other arrangements could also be used to prevent the rotation of latching member 100 on the shell. For instance, a set of protuberances could be provided on body portion 110 sized to seat in a set of recesses provided in the shell 1. Likewise, there could be provided a set of ratchet teeth circumscribing the base of chimney 7 adapted to mate with inwardly oriented serrations provided in aperture 120 to limit the rotation of the latching member.

The lug 152 of the fitment 100 is integrally formed therefrom by provision of a slot 151 which extends inwardly of the disc rim. The inner edge 153 of lug 152 is defined by the outer edge of the slot. The lug 152 is angulated upwardly out of the plane of the body portion 110 and is resiliently deformable towards the plane of body portion 110.

When the tip member 16 is rotated into its closed or non-dispensing position the lug 152 may enter either of finger grip depressions 22 and 23, depending upon the position of the latching member when assembled (in the illustrated embodiment it enters finger grip depression 23), and signal closure by an audible click. As illustrated in FIGS. 3 and 4, when the tip member 16 is in its closed position, the inner edge 153 of the lug 152 engages the side of the depression 23 to prevent inadvertent rotation of the tip member 16 into an open or dispensing position. The lug 152 must be manually depressed into the plane of the disc 110 to disengage the lug from the finger grip depression and allow the dispenser to be rotated into its open or dispensing position as shown in FIGS. 5 and 6.

Although the lug as described herein is designed to coact with the finger grip depressions of the Haller closure, it is understood that the dimensions and shape of the lug could vary in any manner as would be suitable for coaction with indentations or other appropriate surface irregularity on the side wall of a tip portion of any twist-open dispensing closure. In addition to this, it should be noted that it is possible to construct a latching member which has two diametrically opposed lugs instead of the single lug described in the preferred embodiment, without departing from the spirit of the subject invention.

The material to be used in constructing the fitment 100 should have stiffness and resiliency or springback characteristics which permit the lug 152 to properly engage and disengage from the fingertip depressions of the tip member 16 without damage. In this regard, polymers having high flexural strength as measured by ASTM D 790 will fulfill this requirement for resiliency. In addition, the material should be hard in order to physically interact with other components without damage. Another consideration is that the material should be inexpensive in order to lower unit production costs. Lexan, a polycarbonate (Bisphenol A Polycarbonate) manufactured by the General Electric Co., Plastics Div., 1 Plastics Ave., Pittsfield, Mass. 01201, and the preferred material more than adequately fulfills the above criteria. Lexan, unfilled, has a flexural strength of about 949 kg/cm$^2$ and a hardness as measured on the Rockwell Scale of between about M70 to about M82 (ASTM D 785). Barex, an acrylic (Acrylonitrile-butadiene-methyl-acrylate) manufactured by the Vistron Corp. (Subs. Standard Oil Co. [Ohio]), Midland Bldg., Cleveland, Ohio 44115, also has suitable mechanical properties. Barex, unfilled, has a flexural strength of about 984 kg/cm$^2$ and a hardness as measured on the Rockwell Scale of between about M72 to about M78 (ASTM D 785).

A preferred method of forming the fitment 100 is by injection cavity molding techniques where polymers are used. This is advantageous because there are no post-molding strains. It is also possible, but less desirable, to cut the fitment out of a sheet and make suitable fenestrations. The upward bias of the lug is then formed by inducing a permanent set in the plastic. It is also possible to use springy metallic sheet material as the material for fitment 100, in which case the same can be formed by an economical stamping operation.

The twist-open dispensing closure described in Haller and the latching member 100 can be assembled by placing the latching member 100 over the shell 1 such that posts 14 and 15 and chimney 7 align with slots 130 and 140 and aperture 120 of the shell 1. There is no preferred placement of the latching member 100 relative to shell 1 as to favor either side of the shell 2 for the positioning of lug 152 since fingergrip depressions are provided at diametrically opposed locations on tip 16. The latching member 100 in this position can be placed on the shell 1 with chimney 7 extending through aperture 120 and posts 14 and 15 extending through slots 130 and 140. Tip 16 is then snaped onto shell 1 (the snap fit assembly is fully described in the above-identified Haller patent). As described hereinabove, in order to open the closure, the lug is depressed towards the shell thereby disengaging the lug from the fingergrip depression. The tip 16 is then rotated counterclockwise. This rotation shifts the tip 16 away from shell 1 and withdraws the plug 9 from dispensing opening 18 thereby allowing product to flow therethrough. In order to seal the closure, the tip 16 is simply rotated clockwise relative to shell 1. This rotation shifts the tip 16 towards shell 1 and telescopes plug 9 through opening 18. As tip 16 reaches the closed position, latching lug 150 engages a finger grip depression with an audible click signaling closure of the tip 16 and thereby preventing its inadvertent opening.

A particular preferred embodiment of the present invention has been illustrated and described. It will be obvious to those skilled in the art that changes and modifications other than those described hereinabove can be made without departing from the spirit and scope of the invention. It is intended to cover in the appended claims all such changes and modifications that are within the scope of this invention.

What is claimed is:

1. In combination with a twist-open closure comprising a shell member with an outwardly projecting spout having a tip member rotatably mounted theron, said sprout having a dispensing passageway extending therethrough, and wherein limited rotation of said tip member relative to said shell member moves the tip member from a position in which said dispensing passageway is closed to one in which said dispensing passageway is open, such tip member being provided with a pair of opposed finger grip depressions to enable gripping for manual rotation thereof between such open and closed positions, a latching member comprising a disc-like body portion adapted to be disposed between the tip and shell members, said disc-like body portion being provided with means to prevent rotation of said latching member relative to said shell member, at least one aperture enabling telescoping of said spout therethrough and a latching lug connected to said body portion, said lug being angulated upwardly out of the plane of said disc and being resiliently deformable towards the plane of said disc whereby when disposed between such tip and shell members said lug will enter a finger grip depression and signal closure when the tip member is rotated into the closed position, the edge of said lug engaging the side of the depression to thereby prevent inadvertent rotation of said tip member into an open position, manual depression of said lug into the plane of the disc moving said latching lug out of the finger grip depression being required to enable rotation of the tip member to the open position.

2. The combination of claim 1 in which two posts, at opposed locations, project from the surface of said shell and in which the means to limit the rotation of said body portion relative to said shell comprise two diametrically opposed slots in said body contiguous with said aperture, said slots being adapted to receive said posts.

3. The combination of claim 2 in which said disc-like body portion is provided with a single slot extending inwardly of the disc rim to define a latching lug integrally formed from said disc and having an inner edge defined by the outer edge of said slot.

* * * * *